US005428886A

United States Patent [19]

Dupler et al.

[11] Patent Number: 5,428,886

[45] Date of Patent: Jul. 4, 1995

[54] MODULAR TOOLING PACKAGE

[75] Inventors: Robert E. Dupler, Grantville; William J. Remaley, Middletown, both of Pa.

[73] Assignee: The Whitaker Corporation, Wilmington, Del.

[21] Appl. No.: 212,417

[22] Filed: Mar. 11, 1994

[51] Int. Cl.[6] ..... H01R 43/00

[52] U.S. Cl. ..... 29/33 M; 29/566.3; 29/748

[58] Field of Search ..... 29/33 M, 566.3, 564.6, 29/748, 747, 753, 566.1, 566.2

[56] References Cited

U.S. PATENT DOCUMENTS

| | | | |
|---|---|---|---|
| 3,293,735 | 12/1966 | Lovendusky | 227/95 X |
| 3,497,939 | 3/1970 | De Saint-Pierre et al. | 29/564.6 |
| 3,576,063 | 4/1971 | Bakermans | 29/203 |
| 3,699,631 | 10/1972 | Shughart | 29/203 B |
| 3,769,681 | 11/1973 | Eubanks | 29/203 D |
| 3,852,866 | 12/1974 | Johnson | 29/203 B |
| 4,099,316 | 7/1978 | Morgan et al. | 29/566.2 |
| 4,531,280 | 7/1985 | Bakermans | 29/564.6 |
| 4,642,873 | 2/1987 | Bower, Jr. et al. | 29/566.3 |
| 4,667,397 | 5/1987 | Day et al. | 29/748 |
| 4,682,400 | 7/1987 | Casey | 29/566.3 X |
| 4,701,994 | 10/1987 | Noh et al. | 29/568 |
| 4,918,804 | 4/1990 | Bleuel et al. | 29/33 M |
| 5,008,999 | 4/1991 | Correll, Jr. | 29/33 M X |
| 5,115,560 | 5/1992 | Erb et al. | 29/747 |
| 5,131,124 | 7/1992 | Skotek | 29/748 X |
| 5,181,898 | 1/1993 | Piotrowski | 483/3 |
| 5,212,857 | 5/1993 | McMurtry | 29/38 X |

*Primary Examiner*—William Briggs
*Attorney, Agent, or Firm*—Robert J. Kapalka

[57] ABSTRACT

A modular tooling package is disclosed for use in an assembly machine having a plurality of actuators for operating a plurality of tools. The tooling package comprises a module block and a plurality of tools carried by the module block. Each of the tools is arranged for relative movement in response to forces imparted by a respective one of the actuators at a respective separable interface. A means for removably mounting the module block to the assembly machine enables the tooling package to be removed from the assembly machine as an integral unit. The tooling package is operatively coupled to and decoupled from the assembly machine at the respective separable interfaces, thereby enabling the plurality of tool actuators to remain in the assembly machine when the tooling package is removed therefrom.

13 Claims, 17 Drawing Sheets

MODULAR TOOLING PACKAGE

FIELD OF THE INVENTION

The invention relates to a tooling package carrying multiple tools for use in an assembly machine wherein the tooling package is removable and replaceable as an integral unit.

BACKGROUND OF THE INVENTION

Automatic assembly machines are known for sequentially inserting terminals into respective cavities in a connector housing. The terminals are typically formed integral with a carrier strip which can be fed through the insertion machine. The insertion machine includes shear tooling for severing individual terminals from the carrier strip, and insertion tooling for stuffing the severed terminals into their respective cavities in the connector housing. In a known type of insertion machine the shear and insertion tools are discrete members which are individually separable from the machine. In order to change tools such as may be necessary to repair worn or damaged tooling or to accommodate a different size or style of terminal, both the shear tool and the insertion tool must be removed and replaced individually, thereby requiring two removal and replacement operations.

U.S. Pat. No. 4,531,280 to Bakermans discloses a terminal insertion machine having a modular insertion unit which can be removed for repair at a central facility while a replacement unit keeps the insertion machine operational. The modular insertion unit includes a terminal feed mechanism to feed a strip of terminals to a severing station, a terminal clamping and severing mechanism to hold a terminal in position while severing it from its carrier strip and to move the clamped terminal to a stuffing position, an insertion mechanism to drive the severed terminal into a cavity of a connector housing, and a cam drive mechanism to effect synchronous movement of the clamping, severing and insertion mechanisms. This modular insertion unit suffers from the drawback that the cam drive mechanism is included in the housing of the unit, thereby making the unit relatively large and heavy and making removal and replacement the unit difficult. Also, the cam drive mechanism adds greatly to the cost of each unit, thus making it expensive to keep a large quantity of replacement units in stock. Ordinarily, the cam drive mechanism requires little or no maintenance, and the same cam drive mechanism can be used to operate a variety of severing and insertion tools. There is a need for a modular tooling package which overcomes the problems associated with the prior art tooling packages.

SUMMARY OF THE INVENTION

It is an object of the invention to provide a modular tooling package for an assembly machine.

It is another object of the invention to provide a modular tooling package of simple construction which is economical to manufacture.

It is a further object of the invention to provide a modular tooling package which is easily removable and replaceable in a machine.

It is yet another object of the invention to provide a modular tooling package which can be removed from an assembly machine without removal of tooling drive actuators from the machine.

These and other objects are accomplished by a modular tooling package for use in an assembly machine having a plurality of actuators for operating a plurality of tools. The tooling package comprises a module block and a plurality of tools carried by the module block. Each of the tools is arranged for relative movement in response to forces imparted by a respective one of the actuators at a respective separable interface. A means for removably mounting the module block to the assembly machine enables the tooling package to be removed from the assembly machine as an integral unit. The tooling package is operatively coupled to and decoupled from the assembly machine at the respective separable interfaces, thereby enabling the plurality of tool actuators to remain in the assembly machine when the tooling package is removed therefrom.

In one embodiment the module block is especially adapted for use in an assembly machine for sequentially inserting terminals into respective cavities of a connector housing. The module block defines a shear track and an inserter track. Tooling carried by the module block includes a terminal shear which is arranged for guided movement along the shear track in response to forces imparted by a first tool actuator at a first separable interface, and a terminal inserter which is arranged for guided movement along the inserter track in response to forces imparted by a second tool actuator at a second separable interface.

In a preferred embodiment the module block further defines a pressure pad track, and the tooling further includes a pressure pad which is arranged for guided movement along the pressure pad track in response to forces imparted by a third tool actuator at a third separable interface. The pressure pad cooperates with the terminal shear to capture and transport sheared terminals to a terminal insertion zone.

BRIEF DESCRIPTION OF THE DRAWINGS

The invention will now be described by way of example with reference to the accompanying drawings in which like elements in different figures thereof are identified by the same reference numeral and wherein:

FIG. 13 is a front cross-sectional view of the modular tooling package showing tooling in final position prior to insertion of the terminals into a connector.

DETAILED DESCRIPTION OF THE PREFERRED EMBODIMENT

Figure 1:
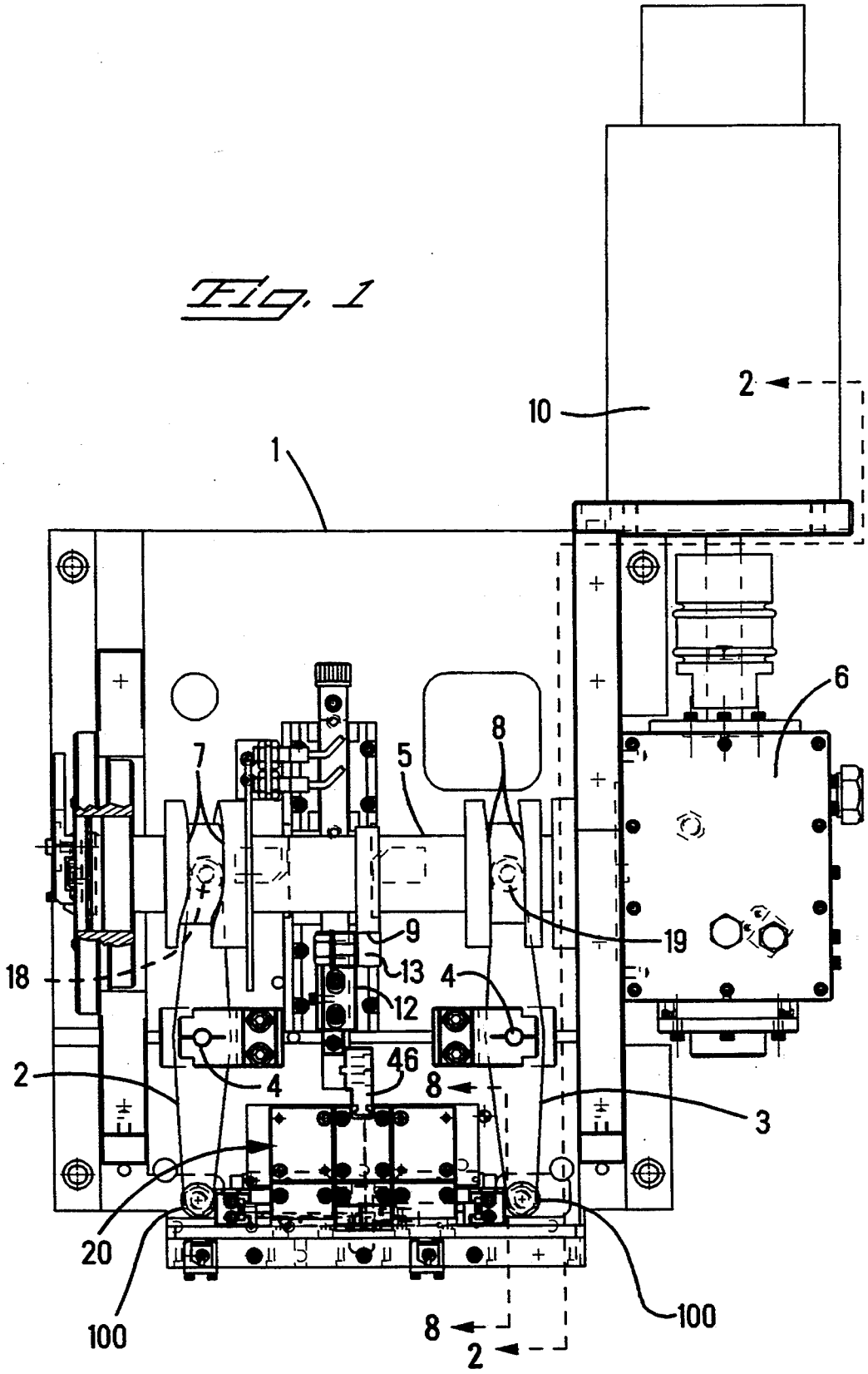
FIG. 1 is a top view of a portion of an assembly machine including tool actuators coupled to a modular tooling package according to the invention.
Figure 2:
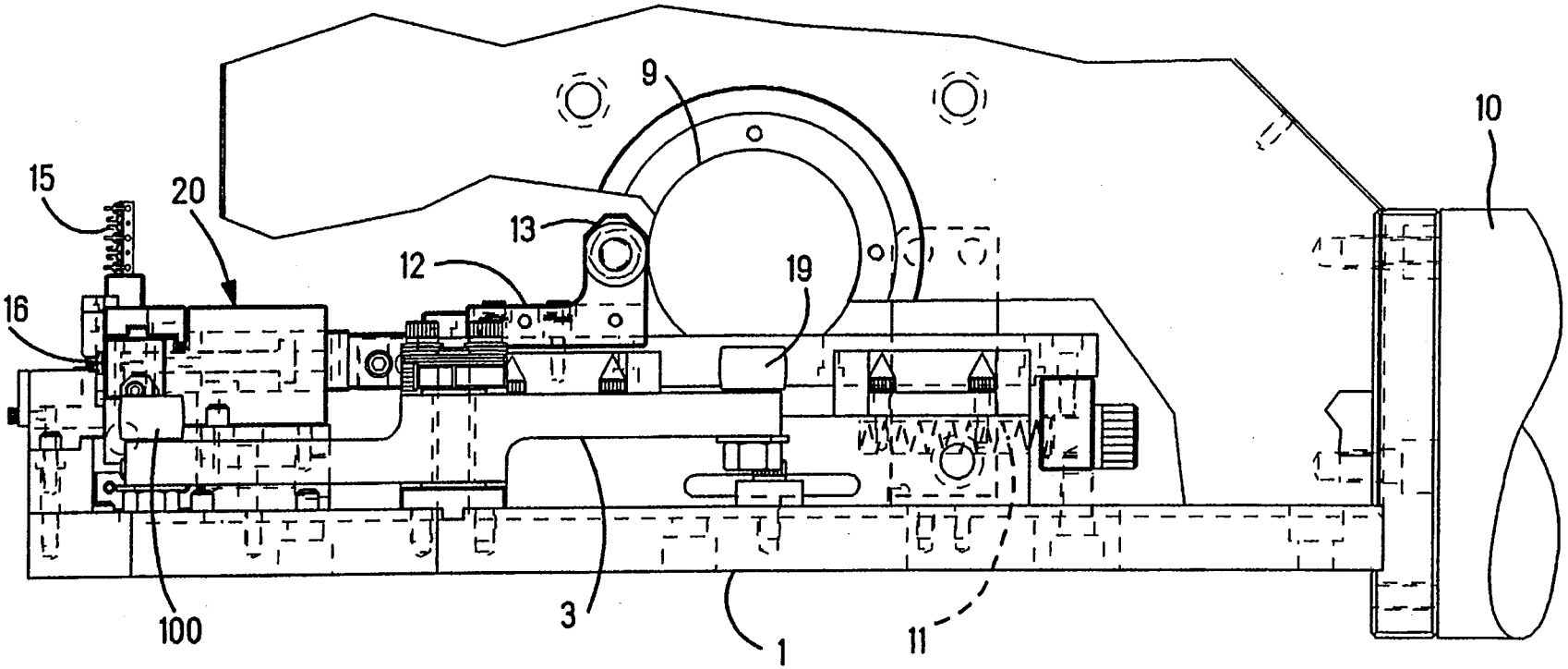
FIG. 2 is a side cross-sectional view of the assembly machine taken along line 2—2 in FIG. 1.

A modular tooling package according to the invention may be adapted for use in a variety of automatic machines having a plurality of tool actuators for operating a plurality of tools. In a preferred embodiment as shown in the drawings, the invention is particularly adapted for use in a machine for sequentially inserting electrical terminals into respective cavities of a connector housing. FIG. 1 is a top view of a portion of the operating mechanism of a terminal insertion machine with which the invention can be used. The insertion machine includes a base plate 1 which rotatably supports a camshaft 5 having barrel cams 7, 8 and radial cam 9. A motor 10 is coupled to a gearbox 6 which is connected to rotatably drive the camshaft 5. Cam links 2, 3 having respective cam followers 18, 19 are each pivotal on a respective pivot pin 4 in response to inputs from the barrel cams 7 and 8, respectively. Slide 12 having cam follower 13 is arranged for straight line motion in response to inputs from the radial cam 9 and return spring 11, which is shown in side view in FIG. 2.

Terminals 15 in strip form and connectors 16 are fed along respective paths through the machine by respective feed and indexing mechanisms (not shown). The machine has a plurality of tool actuators for operating a plurality of tools which shear individual ones of the terminals 15 from the strip and insert the sheared terminals into respective cavities of the connector 16. A first tool actuator includes the barrel cam 7 and the cam link 2; a second tool actuator includes the radial cam 9 and the slide 4; a third tool actuator includes the barrel cam 8 and the cam link 3. Each of the tool actuators also includes a return biasing spring. The return spring 11 is a component of the second tool actuator. Return springs for the first and third tool actuators will be described hereinafter.

According to the invention, the tools which operate on the terminals 15 are contained in a modular tooling package shown generally as 20 which is removable and replaceable in the insertion machine as an integral unit. The modular tooling package carries all of the tooling necessary to shear the terminals 15 from the terminal strip and stuff the sheared terminals into the connector housing. In the illustrated embodiment a pair of the terminals 15 is sheared simultaneously from the terminal strip and thereafter stuffed simultaneously into respective cavities in the connector housing 16. The modular tooling package may be coupled to and decoupled from the tool actuators of the insertion machine at separable interfaces to be more fully described hereinafter.

Figure 3:
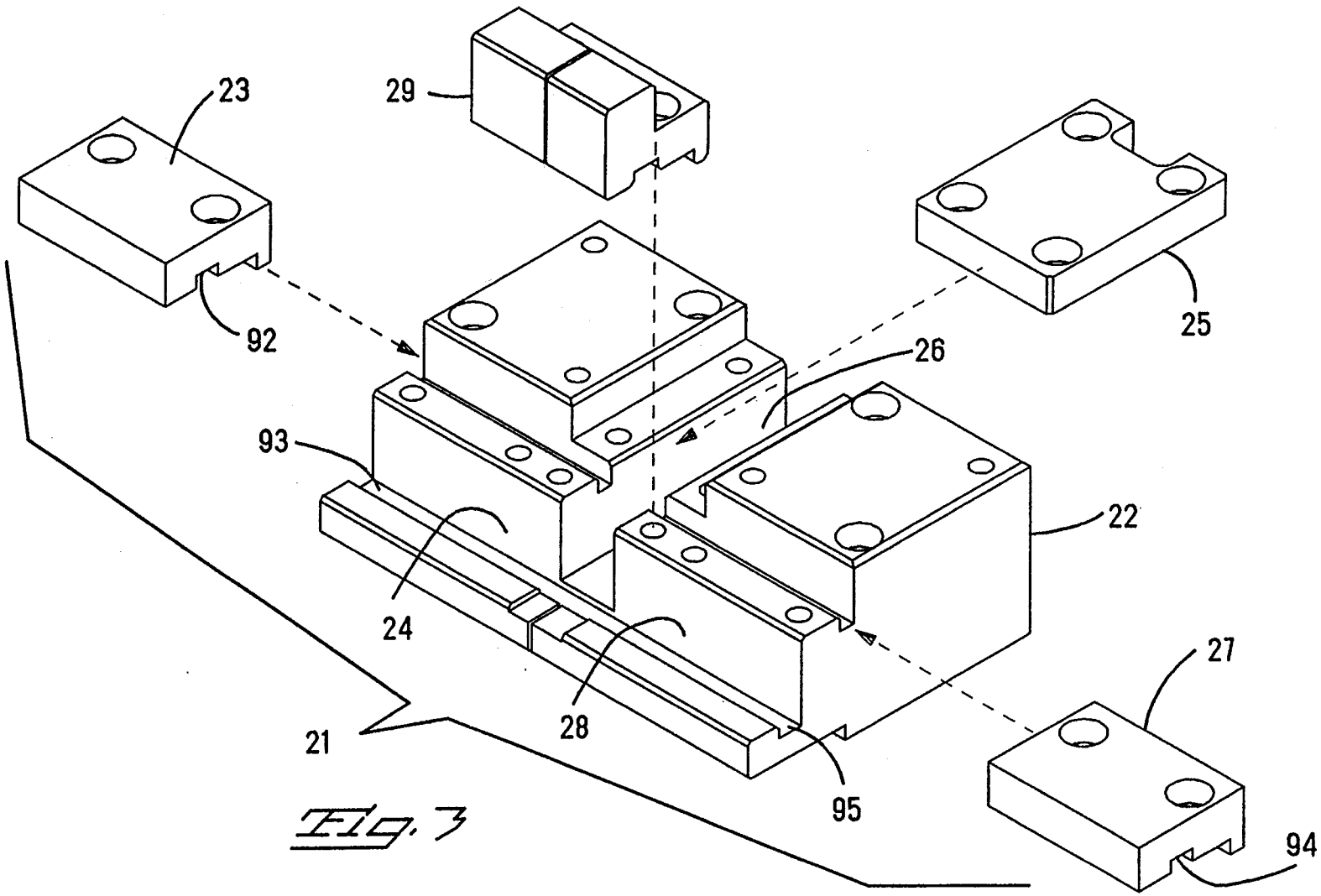
FIG. 3 is an exploded perspective view of a module block for the modular tooling package.

Referring now to FIG. 3, the modular tooling package includes a module block 21 which is preferably constructed as an assembly comprising module block base 22, shear gib 23, insertion gib 25, and pressure pad gib 27. The module block 21 defines shear track 24, inserter track 26, and pressure pad track 28 each of the tracks defining a pathway for a respective tool. The base 22 and the gibs 23, 25, and 27, which are attached to the base 22 by threaded fasteners (not shown), are separately machined during manufacture to facilitate formation of the tracks 24, 26, and 28 during fabrication of the module block 21. After assembly of the module block 21, the gibs 23, 25, and 27 are not normally removed. In the preferred embodiment shown the shear track 24 is a slot of T-shaped cross-section which is partially defined by upper channel 92 in the shear gib 23 and lower channel 93 in the block base 22. The inserter track 24 is a corridor of rectangular cross-section defined in the block base 22 beneath the inserter gib 25. The pressure pad track 26 is a slot of T-shaped cross-section which is partially defined by upper channel 94 in the pressure pad gib 27 and lower channel 95 in the block base 22. The module block 21 further includes a removable die clamp 29 which spans a gap between the shear gib 23 and the pressure pad gib 27 and which allows removable mounting of a stripper and die assembly to be more fully described hereinafter.

Figure 4:
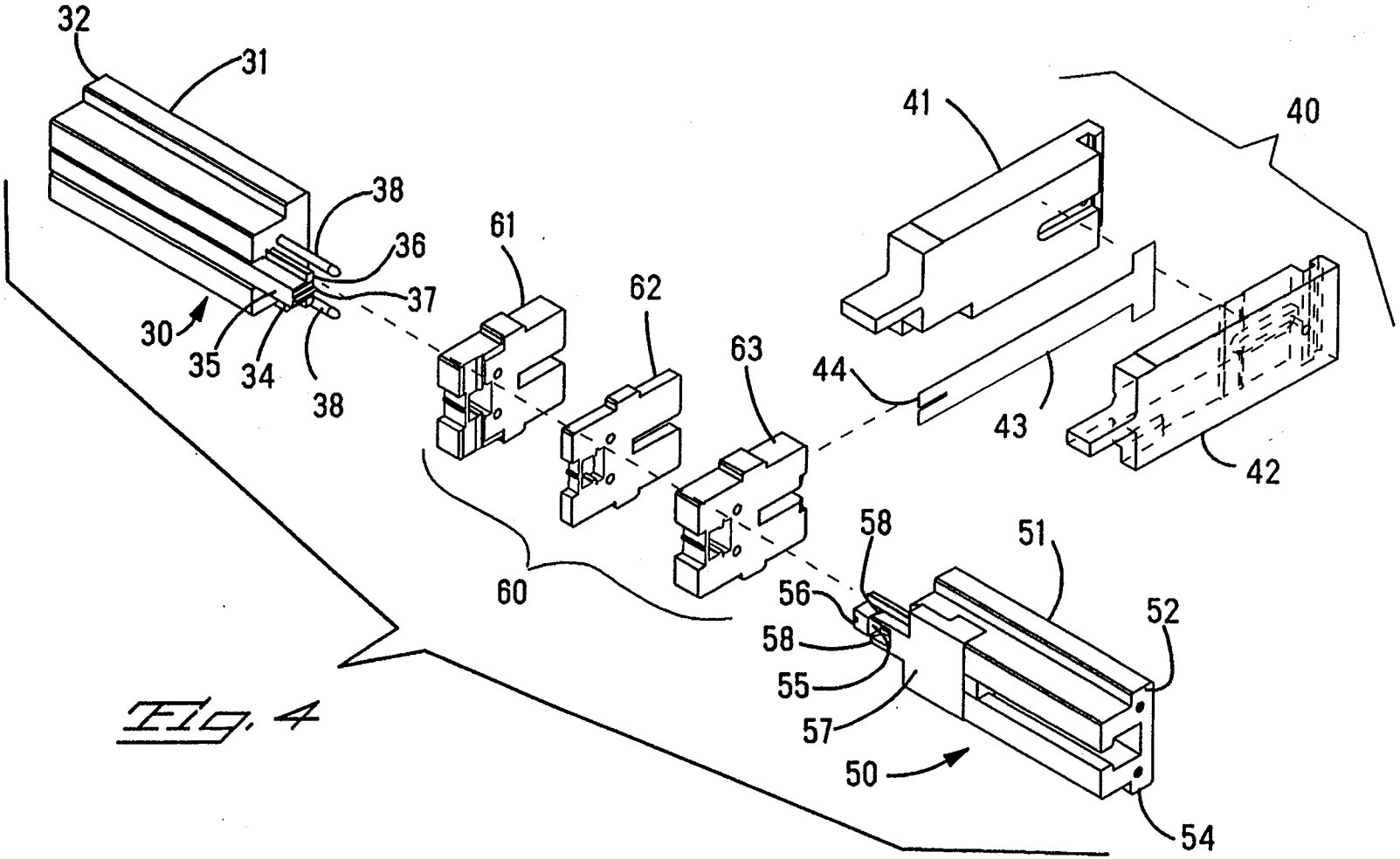
FIG. 4 is an exploded perspective view of tooling carried by 6he module block of the modular tooling package.
Figure 5:
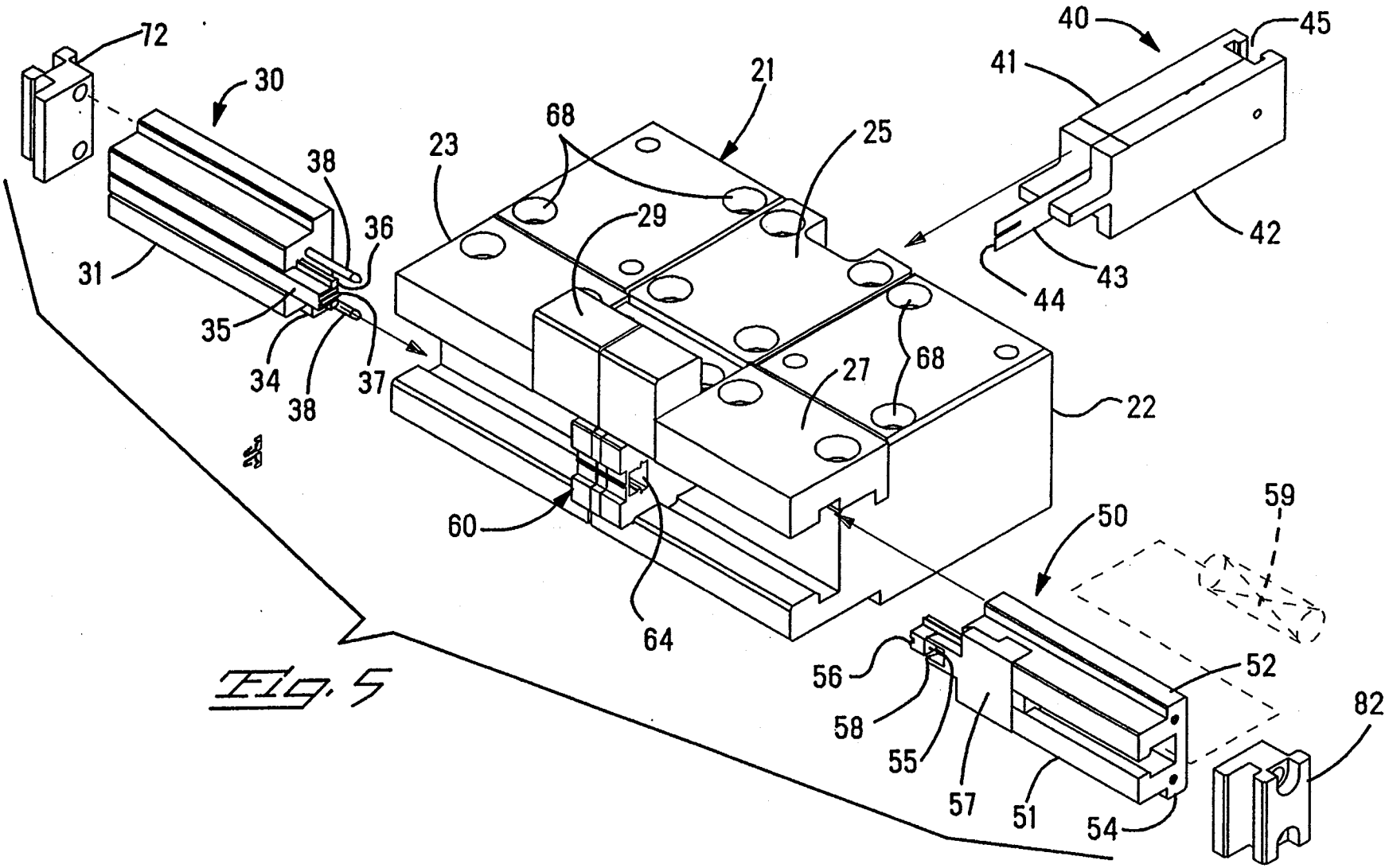
FIG. 5 is a perspective view of a modular tooling package according to the invention with the tooling exploded away therefrom.

Referring now to FIGS. 4 and 5, tooling carried by the module block 21 includes a terminal shear 30, a terminal inserter 40, and a pressure pad assembly 50. The terminal shear 30 includes a shear holder 31 having upper and lower rails 32 and 34 which are slidably receivable within the upper and lower channels 92 and 93, respectively, in the module block 21, thereby providing a means for guiding the terminal shear 30 along the shear track 24 in response to forces imparted by the first actuator which includes the barrel cam 7 and the cam link 2. Shear plug 35 is held in the shear holder 31 by set screws. Shear face 36 of the shear plug 35 is bisected by a rib 37. Pilot pins 38 extend from the shear holder 31 and are receivable in alignment holes defined by a carrier portion of the terminal strip to ensure that the terminal strip is correctly aligned with the terminal shear 30 during a shearing operation.

The inserter 40 is a three piece assembly comprising an inserter holder 41, an inserter cover 42, and an inserter plug 43 which is made from steel shim material. A major portion of the plug 43 resides in a shallow recess formed in the cover 42 and is sandwiched between the holder 41 and the cover 42, while a leading end 44 is disposed outwardly thereof. The inserter 40 is slidable within the inserter track 24 with a very close fit so that the plug 43 is firmly held between the holder 41 and the cover 42. The inserter 40 is moved along the inserter track 24 in response to forces imparted by the second tool actuator which includes the radial cam 9, the inserter slide 12, and the return spring 11 shown in FIG. 2.

The pressure pad assembly 50 cooperates with the terminal shear 30 to capture and transport a pair of sheared terminals to a terminal insertion site in the module block prior to insertion of the sheared terminals into a connector. The pressure pad assembly 50 comprises a pressure pad holder 51 having upper and lower rails 52 and 54 which are slidably receivable in the upper and lower channels 62 and 64 of the module block 21. A pressure pad plug 57 carried by the holder 51 has a pair of projections 58 which assist in confining and guiding the terminals during shear and insertion operations. A pressure pad 55 is biased by spring 59 to extend outwardly of the projections 58. Face 56 of the pressure pad 55 is abutted by the rib 37 of the shear plug 35 during a terminal shear and transport operation. The rib 37 is dimensioned to provide a standoff for the face 36 of the shear plug 35 with respect to the pressure pad face 56, whereby the sheared terminals are closely held between the faces 36 and 56 but are not compressed therebetween.

A stripper and die assembly 60 is a three-piece laminate comprising shear stripper plate 61, die 62, and pressure pad stripper plate 63. The assembly 60 resides in the module block 21 and defines a workstation at a junction of the shear, inserter and pressure pad tracks 24, 26 and 28, and is removably retained beneath die clamp 29 which is attached to the module block 21 by fasteners (not shown). Holes in the plate 61, die 62, and plate 63 which are shaped complementary to both the shear plug 35 and the pressure pad plug 55 are superimposed in the assembly 60 to provide an aperture 64 within which the shear plug 35 and pressure pad plug 55 can operate.

Figure 6:
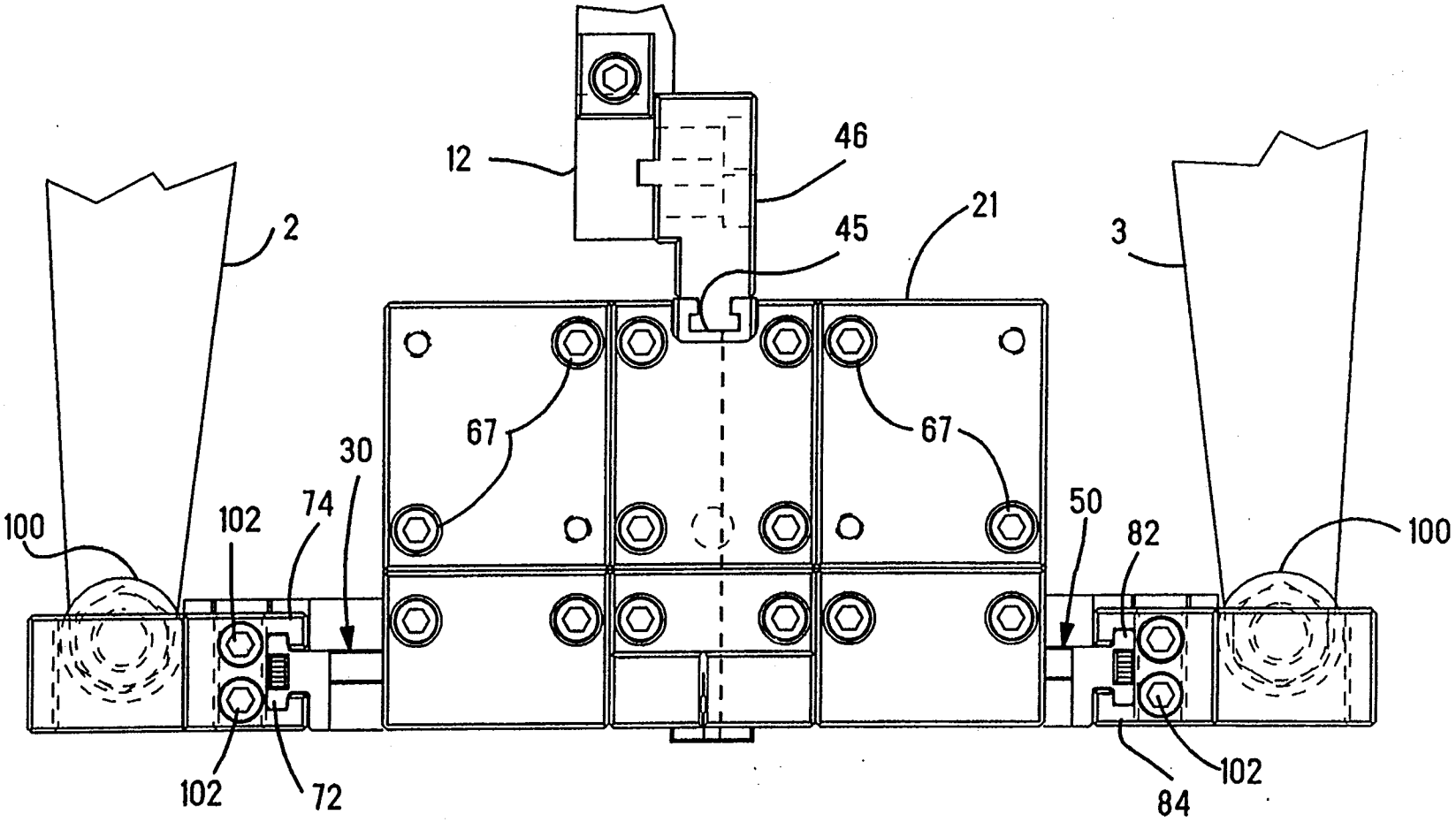
FIG. 6 is a top view of the modular tooling package showing separable interfaces between tools and their respective tool actuators.
Figure 7:
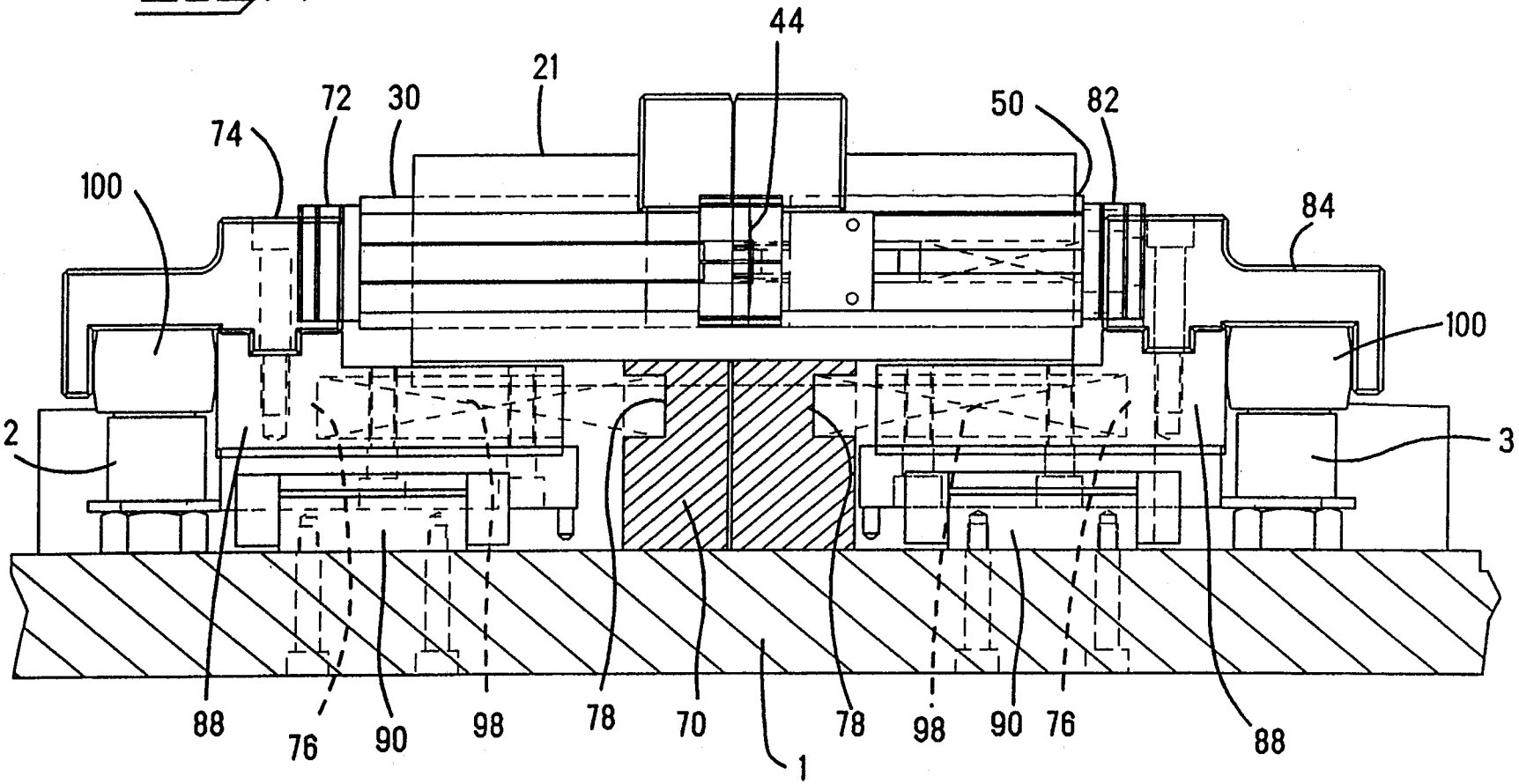
FIG. 7 is a front view of the modular tooling package mounted in an assembly machine and showing couplings with tool actuators of the assembly machine.
Figure 8:
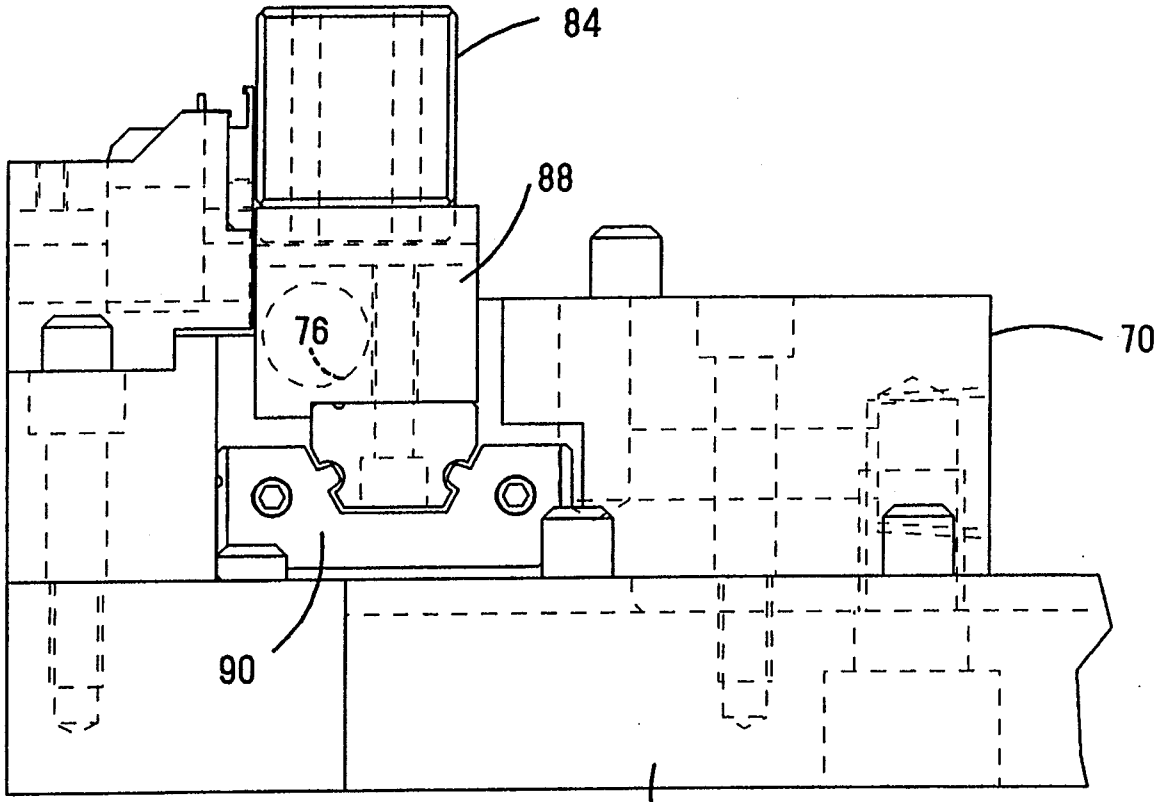
FIG. 8 is a cross-sectional view taken along line 8—8 of FIG. 1.

Referring now to FIGS. 5–7, a first separable interface between the tooling package and the insertion machine comprises a block 72 attached to the shear 30 and having a T-shaped portion slidably receivable in a mating complementary-shaped portion of a shear pusher 74, which is coupled to the first tool actuator. The T-block 72 and the shear pusher 74 define a pair of complementary-shaped members which interlock in a first direction parallel to a direction of guided movement of the terminal shear 30 in the shear track 24, and which are slidably separable in a second direction upwardly transverse to the first direction.

A second separable interface between the tooling package and the insertion machine comprises a T-shaped slot 45 defined by the holder 41 and the cover 42 which receives a complementary T-shaped end of an inserter pusher 46 which is coupled to the second tool actuator. Similar to the arrangement of the T-block 72 and the pusher 74 associated with the shear 30, the complementary T-shaped slot 45 and pusher 46 interlock in a first direction parallel to the direction of sliding movement of the inserter 40, and are slidably separable in a second direction upwardly transverse to the first direction.

A third separable interface between the tooling package and the insertion machine comprises a T-block 82 and a pressure pad pusher 84 which are mirror images of the T-block 72 and the shear pusher 74, respectively. The pressure pad pusher 84 is coupled to the third tool actuator.

With reference to FIGS. 5–8, couplings will now be described between the shear pusher 74 and the first tool actuator, and between the pressure pad pusher 84 and the third tool actuator. These couplings are symmetric on opposite sides of the module block 21 as shown in FIG. 7, hence a description of one coupling suffices to describe the other, and the same reference numbers will be used to refer to like parts of the respective couplings. The pushers 74, 84 are each attached to a respective movable slide 88 by threaded fasteners 102. The movable slide 88 is supported on slide base 90 which is fixed to the insertion machine base 1. A spring 98 has one end confined in a cavity 76 in the slide 88 and another end confined in a cavity 78 in mounting plate 70 which is fixed to the base 1. The spring 98 biases the slide 88 against cam follower 100 at an end of the cam links 2 and 3, thereby taking up any clearance between the slide 88 and the cam follower 100. Each of the springs 98 serves as a component of a respective tool actuator for the shear 30 and the pressure pad assembly 50. The movable slide 88 and the slide base 90 transfer moment loads received from the tool actuators to the machine base 1, thereby preventing moment loads from being imposed on the tooling in the module block.

A means for removably mounting the module block 21 to the insertion machine comprises four threaded fasteners 67 which extend with a slip fit through holes 68 in the module block 21 and are threaded into the mounting plate 70 which is attached to the base plate 1. When the fasteners 67 are removed, the shear 30, inserter 40, and pressure pad assembly 50 may be decoupled from their respective tool actuators at the first, second and third separable interfaces, respectively, by vertically withdrawing the module block 21 from the insertion machine in order to effect sliding disengagement of the associated mating pairs of complementary T-shaped members 72 and 74, 45 and 46, and 82 and 84. Due to the separable interfaces between the tools carried by the module block 21 and their respective tool actuators in the insertion machine, the tooling package comprising the module block 20, the shear 30, the inserter 40 and the pressure pad assembly 50 is removable from the insertion machine as an integral unit, thereby enabling the tool actuators to remain in the machine.

Figure 9:
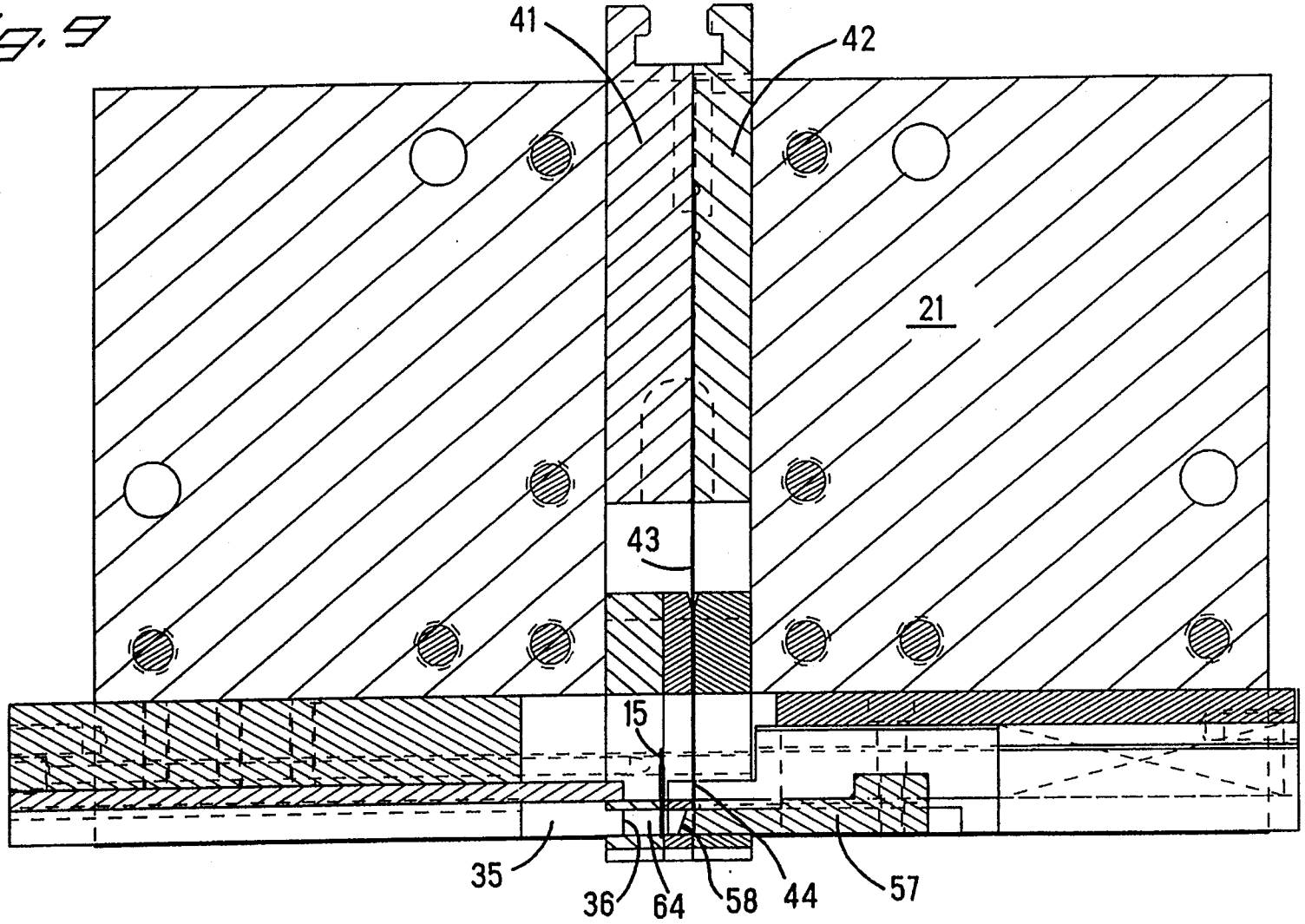
FIG. 9 is a top cross-sectional view of the modular tooling package.
Figure 10:
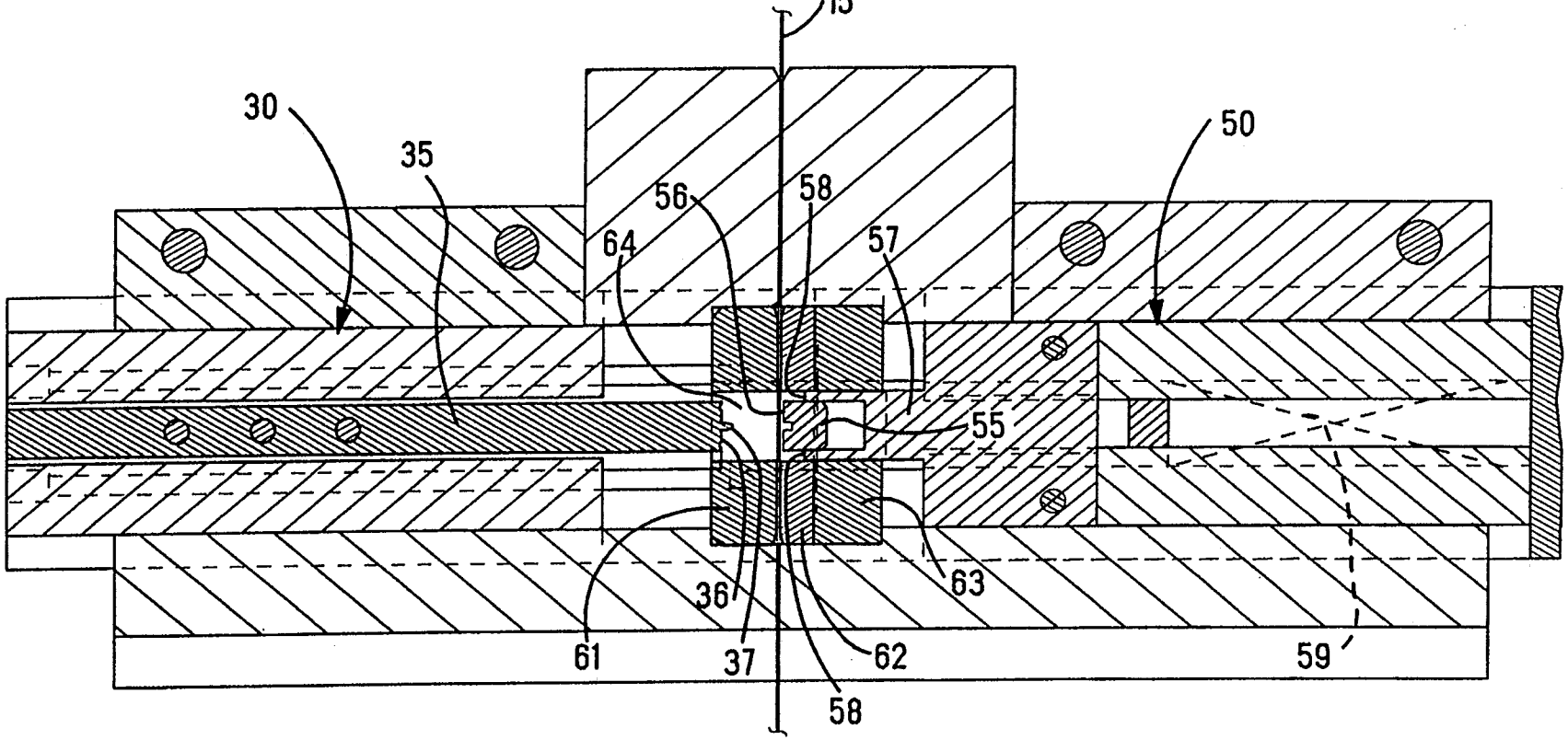
FIG. 10 is a front cross-sectional view of the modular tooling package having tools in an initial position prior to a shearing operation.
Figure 10A:
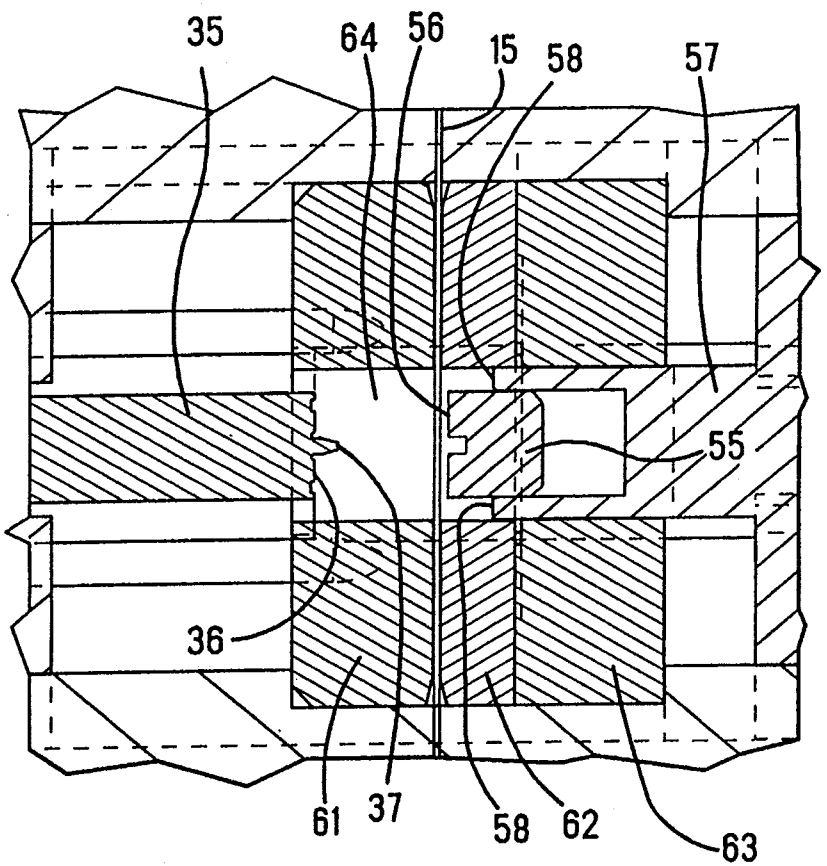
FIG. 10A is an enlarged view of a portion of FIG. 10.

A terminal shearing and insertion operation performed with the modular tooling package will now be discussed. With reference to FIGS. 9, 10 and 10A, a strip of the terminals 15 is fed along a path through the machine between the shear stripper plate 61 and the die 62. Initially, the shear face 36 of the shear 30 is disposed partially within the aperture 64 at a left side of the stripper plate 61. The terminal strip is indexed by the indexing mechanism (not shown) such that a pair of the terminals 15 are disposed in the aperture 64.

Figure 11A:
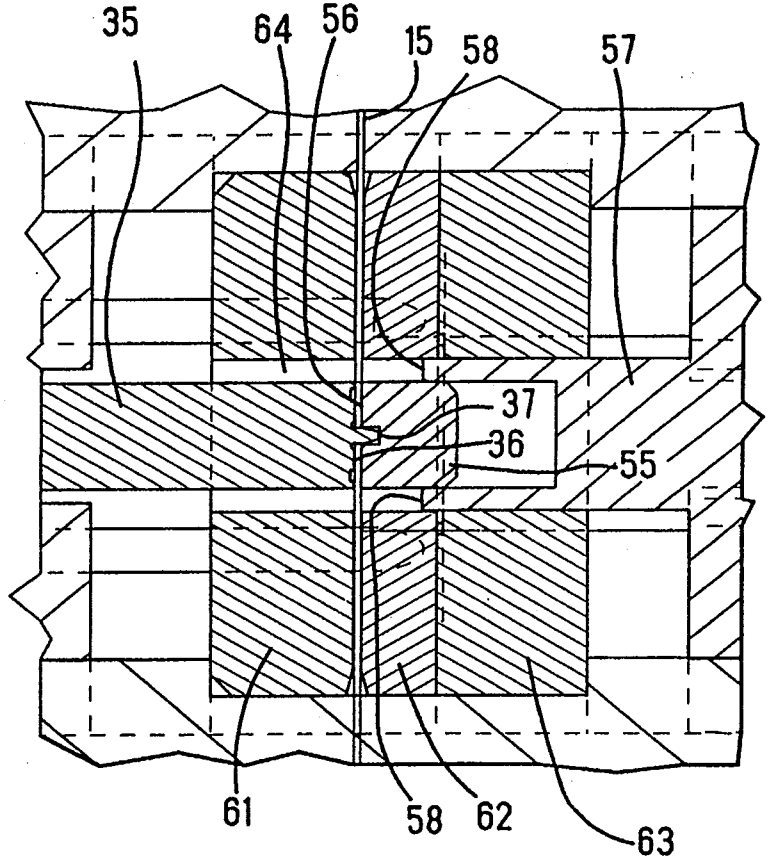
FIG. 11A is an enlarged view of a portion of FIG. 11.
Figure 11:
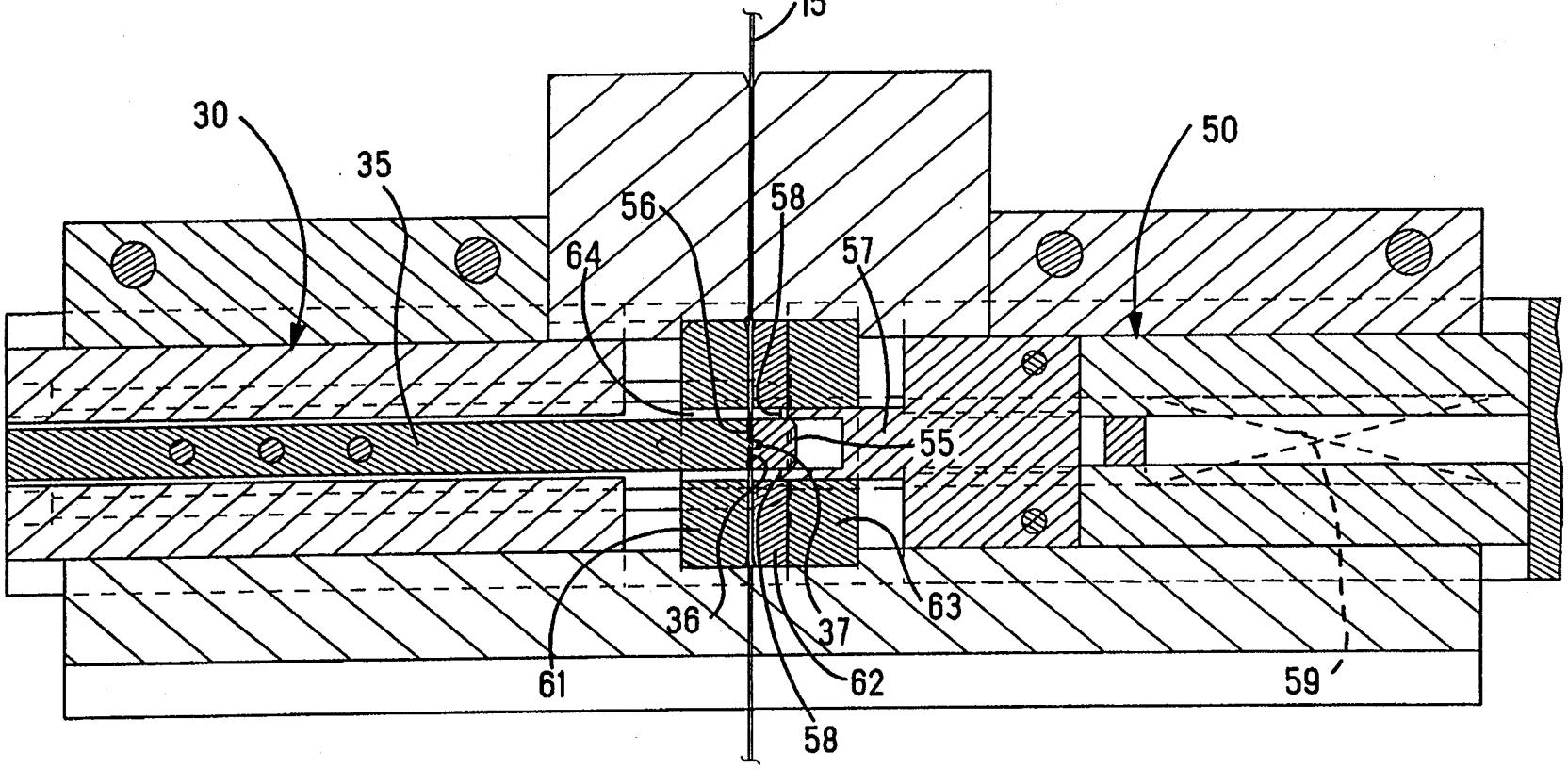
FIG. 11 is a front cross-sectional view of the modular tooling package showing a shearing tool impacting terminals of a terminal strip.

With reference to FIGS. 11 and 11A, movement imparted to the shear 30 by the first tool actuator drives the shear plug 35 rightwardly within the aperture 64. The shear face 36 impacts the pair of terminals 15, whereby the terminals are captured between the shear face 36 and the pressure pad face 56, with the rib 37 disposed between the two terminals 15. The rib 37 is received in a complementary groove of the pressure pad face 56, dimensions of the rib and the groove being selected such that the terminals 15 are closely confined between the shear face 36 and the pressure pad face 56 but are not compressed therebetween.

Figure 12:
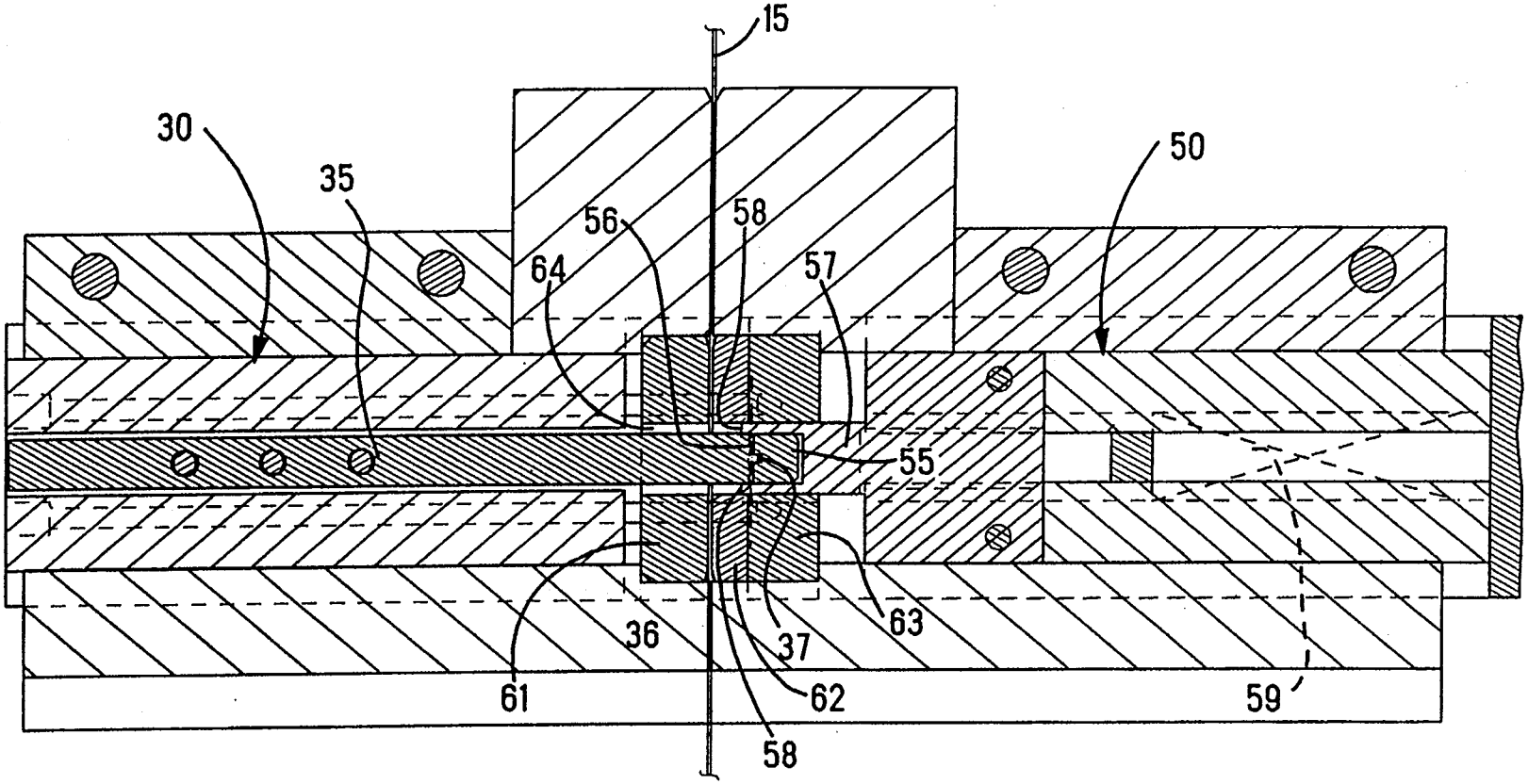
FIG. 12 is a front cross-sectional view of the modular tooling package showing a pair of terminals having been sheared from the strip and transported to a terminal insertion zone.
Figure 17:
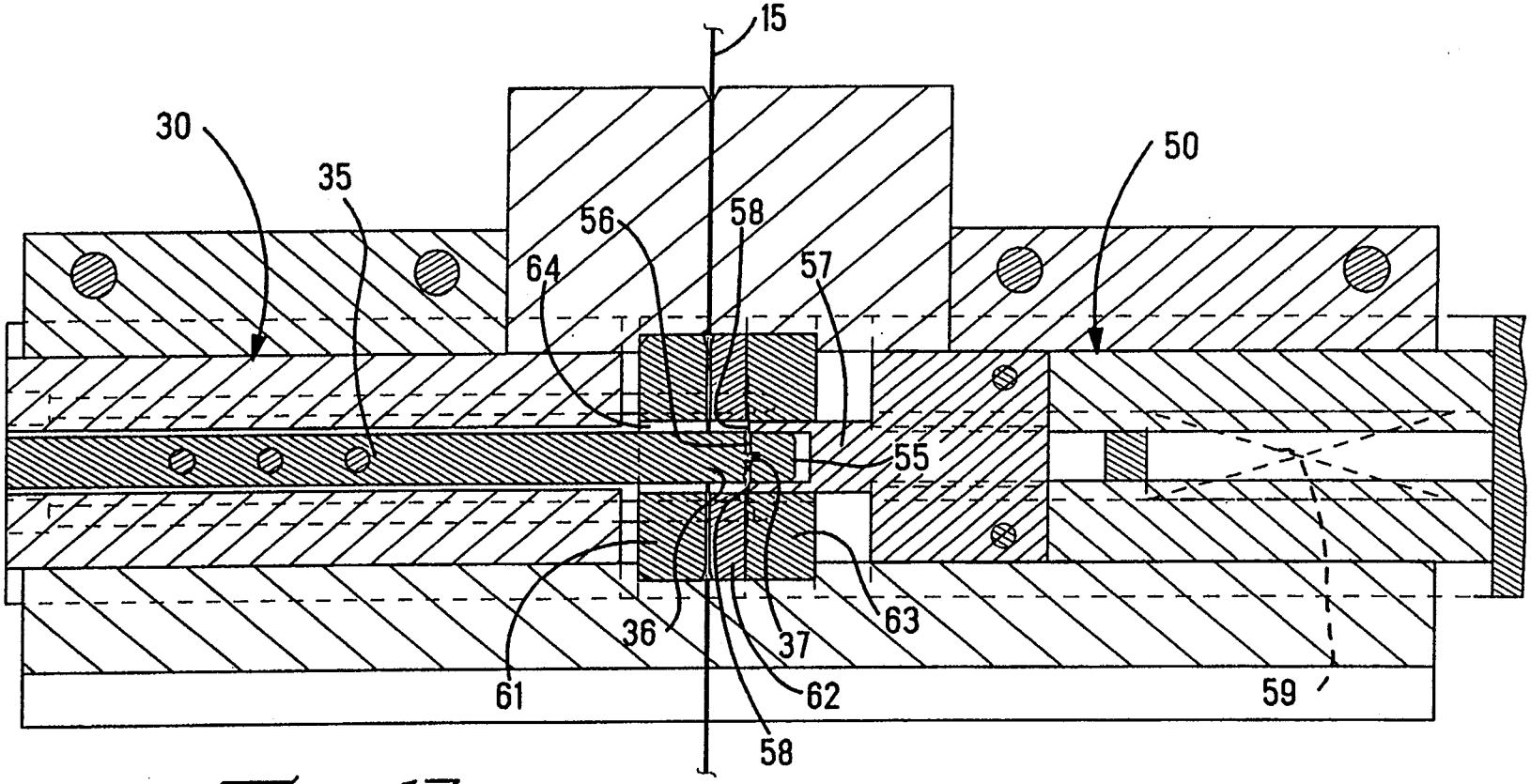
Figure 12A:
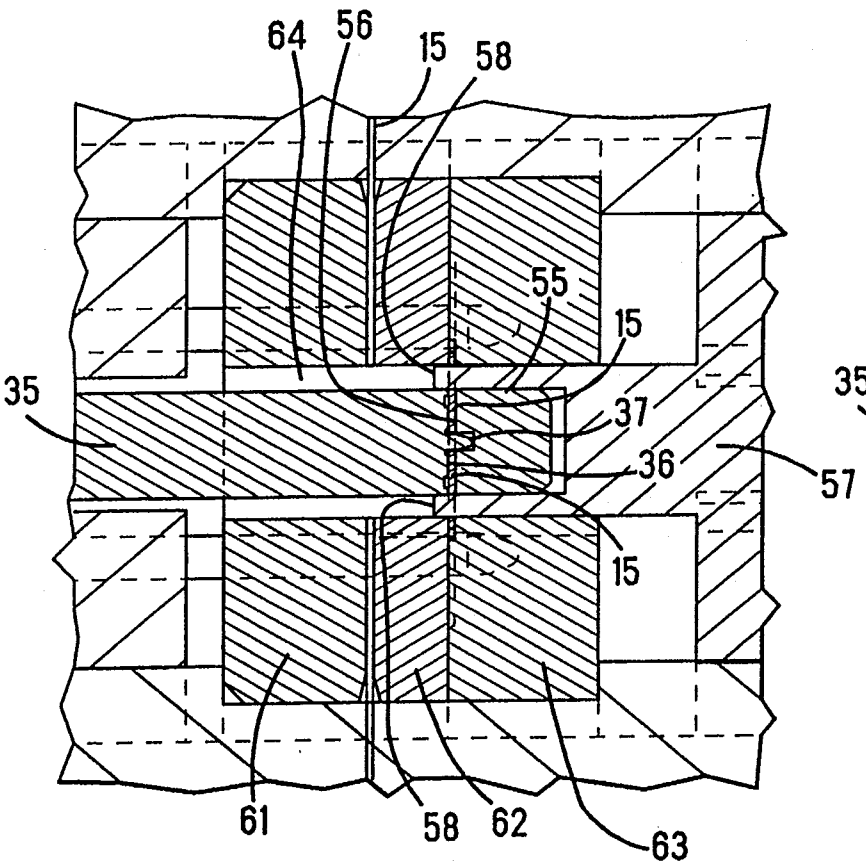
FIG. 12A is an enlarged view of a portion of FIG. 12.

Referring to FIGS. 12 and 12A, the shear plug 35 is driven further along its path within the aperture 64 by its respective tool actuator, thereby shearing the pair of terminals 15 from the terminal strip. The shear plug 35 drives the pressure pad 55 rightwardly against bias of the spring 59 which is housed in the pressure pad assembly. The shear plug 35 and the pressure pad plug 55 thus cooperate to transport the sheared terminals 15 to a terminal insertion zone defined between the die 62 and the stripper plate 63. The pressure pad face 56 is now disposed interiorly of ends of the projections 58 such that the terminals 15 are confined top and bottom by the projections 58.

Figure 13A:
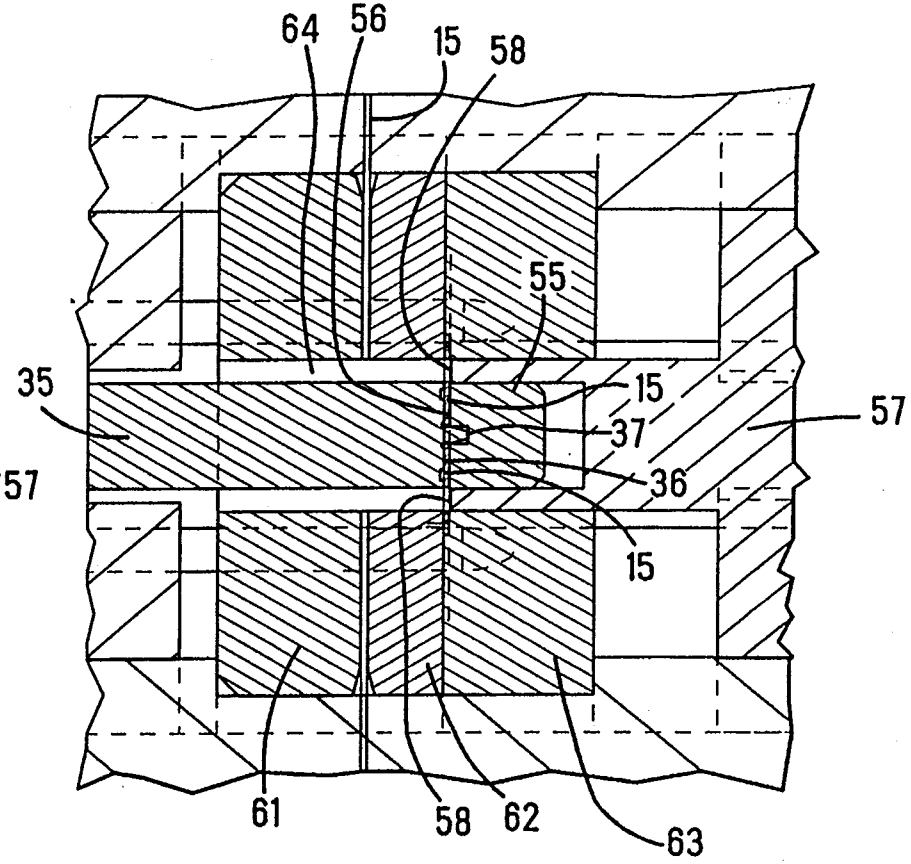
FIG. 13A is an enlarged view of a portion of FIG. 13.
Figure 14:
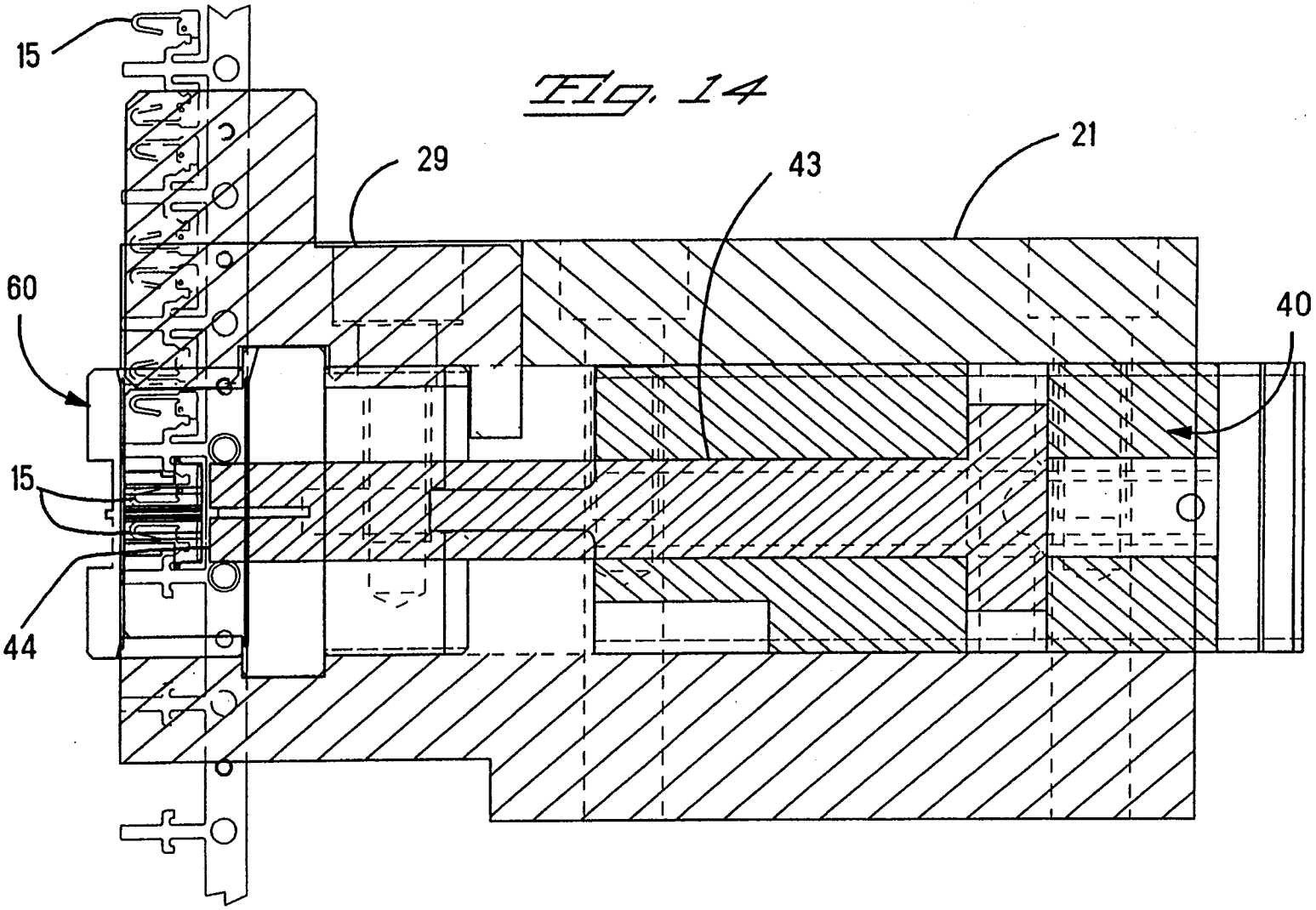
FIG. 14 is a side cross-sectional view of the modular tooling package showing an inserter tool prior to engaging a pair of terminals in a terminal insertion zone.
Figure 15:
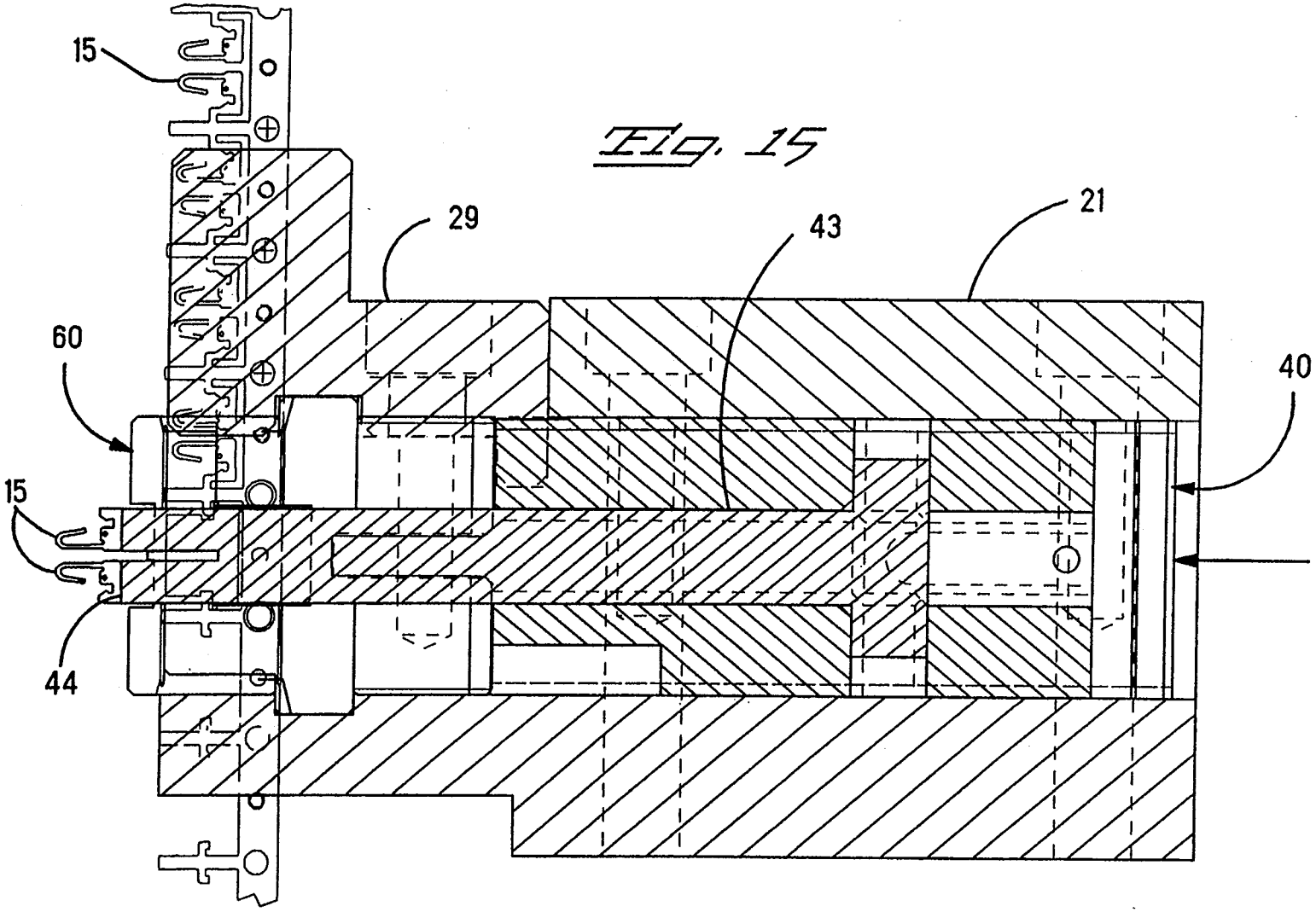
FIG. 15 is a side cross-sectional view of the modular tooling package showing an inserter tool having engaged and ejected a pair of terminals from the insertion zone.

Up to this stage of the shearing and insertion process the terminal inserter 40 which carries the inserter plug 43 is disposed as shown in FIG. 14 with the leading end 44 of the inserter plug being disposed adjacent to base ends of the terminals 15 which are now in the insertion zone. In order to permit expulsion of the terminals during a final stage of an insertion operation, the pressure pad assembly 50 is caused to move a small distance rightwardly by its respective tool actuator, thereby withdrawing the projections 58 from their position straddling the terminals 15 as shown in FIGS. 12 and 12A to a position immediately adjacent to the terminals 15 as shown in FIGS. 13 and 13A. Immediately thereafter the inserter 40 is caused by its respective tool actuator to expel the terminals 15 from the insertion zone, as shown in FIG. 15, thereby stuffing the terminals into respective cavities of a connector housing which is disposed adjacent to the tooling package.

The invention has a number of advantages. The modular tooling package is of relatively simple construction. It can be easily removed and replaced in an assembly machine, thereby enabling changeover of worn, broken or dimensionally different tools with a minimum of machine downtime. Separable interfaces enable the tooling package to be removed without removal of tool actuators from the assembly machine. Alternatively, each tool can be individually removed from the assembly machine by removing its respective connecting linkage and sliding the tool out of the module block, without removing the module block from the machine.

The invention having been disclosed, a number of variations will now become apparent to those skilled in the art. For example, it will be apparent to those skilled in the art that a modular tooling package according to the invention could be constructed without the pressure pad assembly disclosed herein, and that the shear tool could be appropriately modified to singularly carry out the shear and transport functions which have been described as joint functions of the shear and pressure pad tools, thereby enabling the modular tooling package to be operatively coupled to just two actuators. Whereas the invention is intended to encompass the foregoing preferred embodiments as well as a reasonable range of equivalents, reference should be made to the appended claims rather than the foregoing discussion of examples, in order to assess the scope of the invention in which exclusive rights are claimed.

We claim:

1. A modular tooling package for use in a machine having a plurality of tool actuators, the tooling package comprising:

a module block constructed as a unit having a plurality of non-parallel tool pathways which intersect a workstation;

a plurality of tools carried by the module block, each of the tools being arranged for movement along a respective one of the pathways toward the workstation in response to forces imparted by a respective one of the tool actuators at a respective separable interface; and, means for removably mounting the module block to the machine;

wherein the tooling package comprises an integral unit which can be operatively coupled to and decoupled from the machine at the respective separable interfaces, thereby enabling the plurality of tool actuators to remain in the machine when the tooling package is removed therefrom.

2. The tooling package according to claim 1, wherein each of the separable interfaces includes a mating pair of complementary-shaped members.

3. The tooling package according to claim 2, wherein at least one of the mating pairs includes interlocking T-shaped members.

4. A modular tooling package for use in a machine having a plurality of tool actuators, the tooling package comprising:

a module block constructed as a unit having a plurality of non-parallel tool pathways which intersect a workstation;

a plurality of tools carried by the module block and arranged for movement along respective ones of the pathways toward the workstation, each of the tools having means for operably coupling to a respective one of the tool actuators at a respective separable interface; and, means for removably mounting the module block to the machine;

wherein the tooling package comprises an integral unit which can be operatively coupled to and decoupled from the machine at the respective separable interfaces, thereby enabling the plurality of tool actuators to remain in the machine when the tooling package is removed therefrom.

5. The tooling package according to claim 4, wherein the means for operably coupling includes mating pairs of complementary-shaped members.

6. The tooling package according to claim 5, wherein at least one of the mating pairs includes interlocking T-shaped members.

7. A modular tooling package for use in a machine for sequentially inserting terminals at a terminal insertion site into a connector housing, the terminals being joined to a strip thereof fed along a path through the machine, the machine having a plurality of tool actuators for operating a plurality of tools, the tooling package comprising:

a module block defining a shear track and an inserter track;

tooling carried by the module block, the tooling including a terminal shear arranged for guided movement along the shear track in response to forces imparted by a first one of the tool actuators at a first separable interface, and a terminal inserter arranged for guided movement along the inserter track in response to forces imparted by a second one of the tool actuators at a second separable interface; and, means for removably mounting the module block to the machine;

wherein the tooling package comprises an integral unit which can be operatively coupled to and decoupled from the machine at the first and second separable interfaces.

8. The tooling package according to claim 7, wherein the module block further defines a pressure pad tracks and the tooling further includes a pressure pad which is cooperable with the terminal shear to capture a sheared terminal and transport said sheared terminal to the terminal insertion site, the pressure pad being arranged for guided movement along the pressure pad track in response to forces imparted by a third one of the tool actuators at a third separable interface.

9. The tooling package according to claim 8, wherein the terminal shear and the pressure pad are cooperable to capture and transport a pair of sheared terminals to the terminal insertion site.

10. The tooling package according to claim 9, wherein the pressure pad includes projections configured to straddle the pair of terminals.

11. The tooling package according to claim 7, wherein each of the separable interfaces includes a mating pair of complementary-shaped members.

12. The tooling package according to claim 11, wherein each of the pairs of complementary-shaped members interlocks in a first direction parallel to a direction of guided movement of an associated tool, and is slidably separable in a second direction transverse to the first direction.

13. The tooling package according to claim 12, wherein the complementary-shaped members are T-shaped.

* * * * *